United States Patent [19]

Postma

[11] 4,023,263

[45] May 17, 1977

[54] METHOD OF MAKING AN ADJUSTING PIN FOR A FERRO-MAGNETIC CORE

[75] Inventor: Willem Johannes Postma, Eindhoven, Netherlands

[73] Assignee: U.S. Philips Corporation, New York, N.Y.

[22] Filed: Oct. 23, 1975

[21] Appl. No.: 625,019

Related U.S. Application Data

[62] Division of Ser. No. 479,902, June 17, 1974, Pat. No. 3,944,958.

[30] Foreign Application Priority Data

June 18, 1973 Netherlands ..... 7308413

[52] U.S. Cl. ..... 29/607; 29/525

[51] Int. Cl.[2] ..... H01F 41/02

[58] Field of Search ..... 29/602, 607, 525; 336/83, 136, 150

[56] References Cited

UNITED STATES PATENTS 3,508,326 4/1970 Tamm ..... 29/525 X

FOREIGN PATENTS OR APPLICATIONS 1,224,459 3/1971 United Kingdom ..... 336/83

1,136,536 12/1968 United Kingdom ..... 336/136

*Primary Examiner*—Carl E. Hall

*Attorney, Agent, or Firm*—Frank R. Trifari; Bernard Franzblau

[57] ABSTRACT

A method of making an adjusting pin fit into a cylindrical bore in a ferro-magnetic core having a sharp edge includes the step of axially inserting the pin into the bore from the side having the sharp edge whereby the sharp edge cuts off a part of the pin projecting outside of the circumference of the cylindrical bore.

4 Claims, 7 Drawing Figures

METHOD OF MAKING AN ADJUSTING PIN FOR A FERRO-MAGNETIC CORE

This is a division of application Ser. No. 479,902, filed June 17, 1974 now U.S. Pat. No. 3,944,958.

The invention relates to an ajusting pin which is adapted to be connected so as to be axially displaceable in a cylindrical opening which is recessed in a ferromagnetic core. The adjusting pin comprises a ferromagnetic body and a body of synthetic material, the body of synthetic material having a rigid head on one end of the adjusting pin. The largest transverse dimension of the said head is smaller than the diameter of the cylindrical opening. A number of rigid longitudinal ridges is formed on said head. A first end portion of the head faces the said end of the adjusting pin, while a second end portion of the head faces the ferromagnetic body.

In a known adjusting pin of this kind (see British patent specification No. 1,136,536), the longitudinal ridges are shaped as projections of uniform thickness which extend parallel to the axis of the adjusting pin, the thickness of the projections being so large that the head fits in the cylindrical opening of the core with some friction. This friction counteracts unintended displacement of the adjusting pin so that once the inductance of a coil wound onto the core has been adjusted, it will not be changed by shocks or vibrations. However, it was found in practice that the unavoidable production tolerances in the manufacture of the cores and the adjusting pins cause variations in the friction, with the result that in some cases the displacement of the adjusting pin is too difficult during adjustment, whereas in other cases the friction is insufficient to counteract undesired displacement of the adjusting pin.

The elimination of this drawback by the manufacture of cores and adjusting pins having narrower tolerances is not economically very feasible for these mass produced products.

An object of the invention is to provide an adjusting pin in which the drawbacks of the known adjusting pins are avoided without additional cost. To this end, the adjusting pin according to the invention is characterized in that the thickness of the longitudinal ridges uniformly varies (tapers) over at least a part of their length, the thickest part being situated near the first end portion of the head, the arrangement being such that the diameter of the circumscribed circle of the head with longitudinal ridges is larger near the first end portion and is smaller near the second end portion than the diameter of the cylindrical opening.

The cylindrical opening of the core has a sharp edge on one end. When an adjusting pin according to the invention is inserted into a core for the first time, it is at the same time automatically fitted to the cylindrical core opening. To this end, the adjusting pin is inserted into the cylindrical opening from the end having the sharp edge far enough so that the longitudinal ridges bear against the sharp edge, after which the adjusting pin is further displaced in the axial direction so that the parts of the longitudinal ridges which project beyond the circumference of the cylindrical opening are cut off by the sharp edge.

The adjusting pin then very accurately fits in the cylindrical opening. In order to prevent this accuracy from being partly lost at a later stage due to variations of, for example, the ambient temperature or the air humidity, it is important that the material of the head be insusceptible to such influences. It was found that this requirement can be met by using polypropylene for the body of synthetic material or by using a modification of polytetrafluoroethylene, suitable for injection moulding, as a base material with a granular filling substance whose part by volume amounts to 25–75%. The filling substance preferably contains materials having a high melting point such as tungsten oxide, titanium, titanium oxide, aluminium oxide, and calcium carbonate. A material having a low coefficient of expansion is thus obtained.

The invention will be described in detail hereinafter with reference to the accompanying drawing in which.

Figure 1:
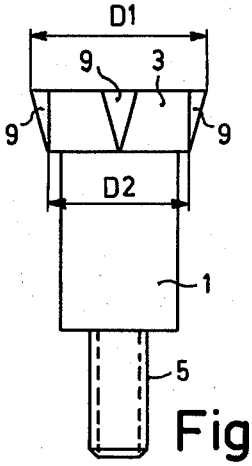
FIG. 1 is a side elevation of an adjusting pin according to the invention.
Figure 4:
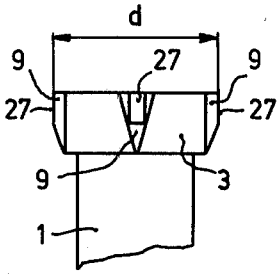
Figure 3:
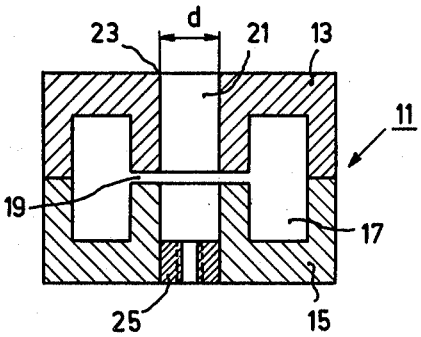
Figure 5:
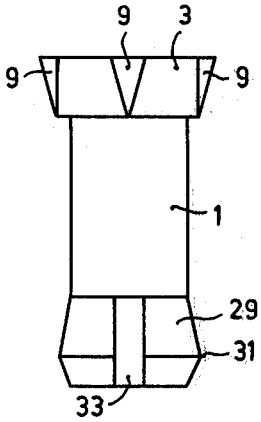
Figure 6:
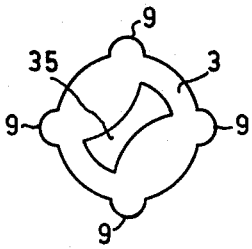
Figure 7:
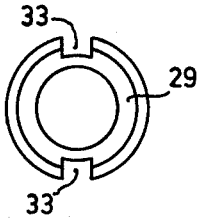

FIG. 3 is a sectional view to a reduced scale of a ferromagnetic core which can co-operate with the adjusting pin shown in FIG. 1, FIG. 4 is a side elevation of the head of the adjusting pin shown in FIG. 1 after the pin has been made to fit the core shown in FIG. 3, FIG. 5 is a side elevation of another embodiment of an adjusting pin according to the invention, FIG. 6 is a plan view of the adjusting pin shown in FIG. 5, and FIG. 7 is a bottom view of the same adjusting pin.

Figure 2:
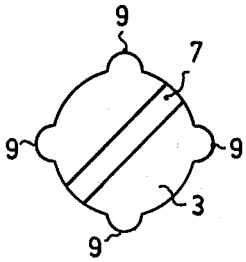
FIG. 2 is a plan view of the adjusting pin shown in FIG. 1.

The adjusting pin shown in FIG. 1 consists of a cylindrical ferromagnetic body 1 which is arranged on a body of synthetic material which comprises a head 3 on one end and a threaded portion 5 on the other end. The head 3 (see also FIG. 2) is provided with a groove 7 which can co-operate with a screwdriver. A number of longitudinal ridges 9 (four in this case) are formed on the head 3.

The adjusting pin can co-operate with a ferromagnetic core 11 which is shown to a reduced scale in FIG. 3. The core 11 consists of an upper half 13 and a lower half 15 which are arranged such that an annular winding space 17 exists in which there is room for a coil winding (not shown). Except for an air gap 19 which extends towards the centre of the core 11, the winding space 17 is completely enveloped by the ferromagnetic material of the core. In the centre of the core 11 a cylindrical opening 21 is recessed and is provided with a sharp edge 23 on one end, the other end thereof being closed by a nut 25 which can co-operate with the thread 5 on the lower part of the adjusting pin when the latter is inserted into the cylindrical opening. When the adjusting pin is turned, the ferromagnetic body 1 is axially displaced with respect to the air gap 19 so that the inductance of a winding present in the winding space 17 can be accurately adjusted. In order to make the head 3 fit exactly in the cylindrical opening 21, the thickness of the longitudinal ridges 9 formed on the head uniformly decreases over their length, the thickest part being situated near the upper end portion of the head and the thinnest part being situated near the lower end portion which faces the ferromagnetic body 1.

The head 3 with the tapered longitudinal ridges 9 has a circumscribed circle having a diameter D1 near its upper end portion, and a circumscribed circle having a smaller diameter D2 near its lower end portion. The internal diameter $d$ of the cylindrical opening 21 is between D1 and D2.

When the adjusting pin is inserted into the cylindrical opening for the first time, the head 3 partly disappears in the opening until the longitudinal ridges 9 bear on the sharp edge 23. The head 3 and the longitudinal ridges 9 are rigid so that elastic deformation thereof is substantially impossible. If the adjusting pin is subsequently turned further inwards, the parts of the longitudinal ridges 9 which project beyond the circumference of the cylindrical opening 21 are cut off by the sharp edge 23, with the result that the upper portion of the head 3 with the longitudinal ridges 9 fits exactly in the cylindrical opening having a diameter *d*. A side elevation of the head is then as shown in FIG. 4. The longitudinal ridges 9 have cylindrical cutting faces 27.

It was found that the high accuracy of the adjusting pin thus achieved is liable to be partly lost again at a later stage under the influence of variations of the ambient temperature or due to the air humidity if the body of synthetic material (and in particular the head 3) is made of a commonly used synthetic material as the basic material with the addition of a fibrous filling material such as glass fibres or asbestos fibres. This is because the dimensions of the head 3 change due to thermal expansion and/or absorption of moisture by the material. The high initial accuracy, however, appears to be maintained very well if the head 3 (and preferably the entire body of synthetic material) is made of polypropylene or a modification of polytetrafluorethylene, suitable for injection moulding, as a basic material along with a granular filling substance which, moreover, has a high melting point. Suitable materials in this respect are, for example, tungsten, tungsten oxide, titanium, titanium oxide, aluminium oxide, calcium carbonate.

Favourable results were obtained with a part by volume of the filling substance of between 25 and 75%, optimum results being obtained at approximately 50%. In order to prevent dimensional changes of the nut 25 from causing a displacement of the adjusting pin, the nut is preferably made of the same material as the body of synthetic material. The nut 25 can be embedded in the material of the core 11, the shape of the nut being chosen such that rotation and axial displacement thereof are prevented (not shown).

FIGS. 5 to 7 show another embodiment of the adjusting pin according to the invention in which the nut 25 can be dispensed with. As is shown in the side elevation of FIG. 5 and the plan view of FIG. 6, this adjusting pin also comprises a ferrite body 1 and a body of synthetic material with a head 3 on which longitudinal ridges 9 which thicken or taper in the upwards direction have been formed. However, the lower portion of the body of synthetic material comprises, instead of the thread 5, a smooth annular portion 29 which has a thickened portion 31, the diameter of which is so large that it fits in the cylindrical opening 21 of the core 11 with some friction. So as to achieve better compensation for dimensional inaccuracies, the annular portion 29 is rendered slightly compressable by way of two longitudinal grooves 33 (see also the bottom view of FIG. 7). The vertical displacement of this threadless adjusting pin is effected by means of, for example, a screwdriver in a manner as described in Netherlands Patent Application 7007312. The head 3 therefore comprises, instead of a straight groove 7, a butterfly-shaped recess 35.

It will be obvious that within the scope of the invention deviations from the described embodiments are feasible. For example, instead of four longitudinal ribs 9 a different number, larger than two, can be chosen. Alternatively, the thickness of the longitudinal ridges 9 can be made to vary over only a part of their length, or their length can be made smaller than the height of the head 3. If desired, provisions other than the groove 7 or the recess 35 and adapted to special tools can be made on the head. The part of the adjusting pin which projects below the ferrite body 1 can alternatively be made of a material other than that of the head 3, for example, of a different synthetic material or of metal.

What is claimed is:

1. A method of making an adjusting pin comprised of a body of ferromagnetic material fit into a cylindrical opening in a ferromagnetic core comprising the steps of forming on one end of said ferromagnetic body a head composed of a rigid synthetic material having longitudinal ridges protruding therefrom, a part of said ridges having a larger diameter than the diameter of said core opening, forming a sharp edge on one end of the core opening sufficient to cut off excess material from said longitudinal ridges, inserting the adjusting pin into the cylindrical opening from the end having the sharp edge until the longitudinal ridges bear on the sharp edge and further displacing the adjusting pin along the axial direction of said opening so that the parts of the adjusting pin longitudinal ridges which project beyond the circumference of the cylindrical opening are cut off by the sharp edge thereby to form an interference fit.

2. A method as recited in claim 1 comprising the step of forming a taper on said longitudinal ridges before said step of inserting the pin into the cylindrical opening, said taper having a part with a diameter smaller than and another part with a diameter larger than the diameter of the core opening.

3. A method as recited in claim 1 wherein said synthetic material is chosen from the group of materials consisting of polypropylene and polytetrafluoroethylene.

4. The method of claim 1 wherein said ridges are equally spaced about the circumference of the adjusting pin.

* * * * *